US006152145A

United States Patent [19]

Focke

[11] Patent Number: 6,152,145

[45] Date of Patent: Nov. 28, 2000

[54] PROCESS AND APPARATUS FOR PRODUCING A (CIGARETTE) ROD

[75] Inventor: Heinz Focke, Verden, Germany

[73] Assignee: Focke & Co. (GmbH & Co.), Verden, Germany

[21] Appl. No.: 09/080,877

[22] Filed: May 18, 1998

[30] Foreign Application Priority Data

May 21, 1997 [DE] Germany ..... 197 21 143

[51] Int. Cl.[7] ..... A24C 1/26; A24C 5/08; A24C 5/10

[52] U.S. Cl. ..... 131/58; 131/55; 131/60; 131/105; 131/27.1; 198/823; 198/833; 53/439; 53/466

[58] Field of Search ..... 131/27.1, 55, 58, 131/60, 105; 53/461, 439, 466; 198/823, 833

[56] References Cited

U.S. PATENT DOCUMENTS

| | | |
|---|---|---|
| 567,644 | 9/1896 | Hardie . |
| 587,824 | 8/1897 | Hudson . |
| 1,313,111 | 12/1919 | Page . |
| 1,723,942 | 8/1929 | Koerner . |
| 1,838,110 | 12/1931 | Rundell . |
| 1,876,029 | 9/1932 | Smith . |
| 3,173,188 | 3/1965 | Wexler . |
| 3,252,465 | 5/1966 | Kaufmann . |
| 3,380,351 | 4/1968 | Cox et al. . |
| 3,477,441 | 11/1969 | McArthur . |
| 3,716,443 | 2/1973 | Preston . |
| 4,164,229 | 8/1979 | Hurt . |
| 4,718,541 | 1/1988 | Wilding . |

FOREIGN PATENT DOCUMENTS

| | | |
|---|---|---|
| 0726031 | 8/1996 | European Pat. Off. . |
| 673628 | 4/1939 | Germany . |
| OS2311415 | 9/1974 | Germany . |
| 2531488 | 2/1977 | Germany . |
| 2836030C2 | 3/1979 | Germany . |
| 34425 | 3/1931 | United Kingdom . |
| 2108819 | 5/1983 | United Kingdom . |

*Primary Examiner*—Stanley S. Silverman
*Assistant Examiner*—Michael P. Colaianni
*Attorney, Agent, or Firm*—Abelman, Frayne & Schwab

[57] ABSTRACT

For the continuous production of the cigarette rod (10), the strip-like outer wrapper (12) and a tobacco strand (11) are provided on a forming belt (15) and conveyed, with the latter, through a rod-forming unit (13). Located within the latter is a forming bed (19) which, during transportation, deforms the forming belt (15) along with the outer wrapper (12) and the tobacco rod (11) so as to produce a cigarette rod (10). A compensating belt (21) is provided in order to avoid or reduce the friction of the forming belt on the forming bed (19), and said compensating belt circulates at reduced speed between the forming belt (15) and forming bed (19) The compensating belt (21) reduces the friction and dissipates (frictional) heat.

13 Claims, 2 Drawing Sheets

PROCESS AND APPARATUS FOR PRODUCING A (CIGARETTE) ROD

DESCRIPTION

The invention relates to a process for producing a continuous rod with an outer wrapper, in particular a cigarette rod comprising an outer wrapper made of (cigarette) paper, it being the case that the outer wrapper, which is fed continuously as a material strip, and the material which is to be wrapped, in particular tobacco, rest on a conveyor, in particular on a forming belt, and are formed into a rod during transportation by (fixed) wrapping elements—forming beds—resting against a free side of the forming belt. The invention also relates to an apparatus for carrying out the process.

A rod-forming machine constitutes an important part of a cigarette-producing machine. Said rod-forming machine is used for the continuous production of a continuous cigarette rod. The latter comprises a usually cylindrical tobacco rod with an outer wrapper made of cigarette paper.

During production of the cigarette rod, a tobacco rod rests on the outer wrapper, which is likewise fed continuously as a material strip, and is transported through a rod-forming unit by a belt conveyor, namely by a forming belt. The rod-forming unit has elements for deforming the tobacco rod and the material strip such that the latter fully encases the tobacco rod. The finished, continuous cigarette rod emerges from the rod-forming unit.

The wrapping elements for deforming the tobacco rod and/or outer wrapper are positioned in a stationary manner and are preferably designed as a forming bed. The belt conveyor, that is to say the forming belt, rests on the forming bed and during transportation is deformed, together with the outer wrapper and tobacco rod, by said forming bed. The very high conveying speed of the forming belt and the resulting high friction cause a correspondingly high degree of frictional heat, which is disadvantageous for the production process and the product.

The object of the invention is, during the production of a continuous rod with an outer wrapper, in particular during the production of a cigarette rod, to reduce the development of heat in the region of the rod-forming unit or of the wrapping elements.

In order to achieve this object, the process according to the invention is characterized in that heat which is produced in the region of the wrapping elements or of the forming bed is dissipated by relatively large or additional surfaces and/or by using material of high thermal conductivity.

Accordingly, the idea of the invention is that the heat which is produced by the friction should be distributed over additional sheet-like elements which provide for rapid heat dissipation and thus a reduction in the transmission of heat to the rod.

In the case of the apparatus for carrying out the process, the invention provides, in addition to the forming belt, a further belt which runs through the rod-forming unit, namely an intermediate belt. The latter is positioned between the belt conveyor or forming belt, on the one hand, and the fixed element which produces the friction, that is to say the forming bed, on the other hand. Accordingly, the intermediate belt rests against the forming bed and dissipates some of the heat produced. Moreover, there is a reduction in the wear on the forming belt.

According to a further important proposal of the invention, the intermediate belt is driven at a lower speed than the forming belt. This results, on the one hand, in (reduced) friction of the intermediate belt on the forming bed and, on the other hand, in likewise reduced friction between the forming belt and the intermediate belt. The latter consists of a selected material of high strength, formability and high thermal conductivity as well as a low coefficient of friction.

Further details of the invention are explained more precisely hereinbelow with reference to an exemplary embodiment illustrated in the drawings, in which.

Figure 1:
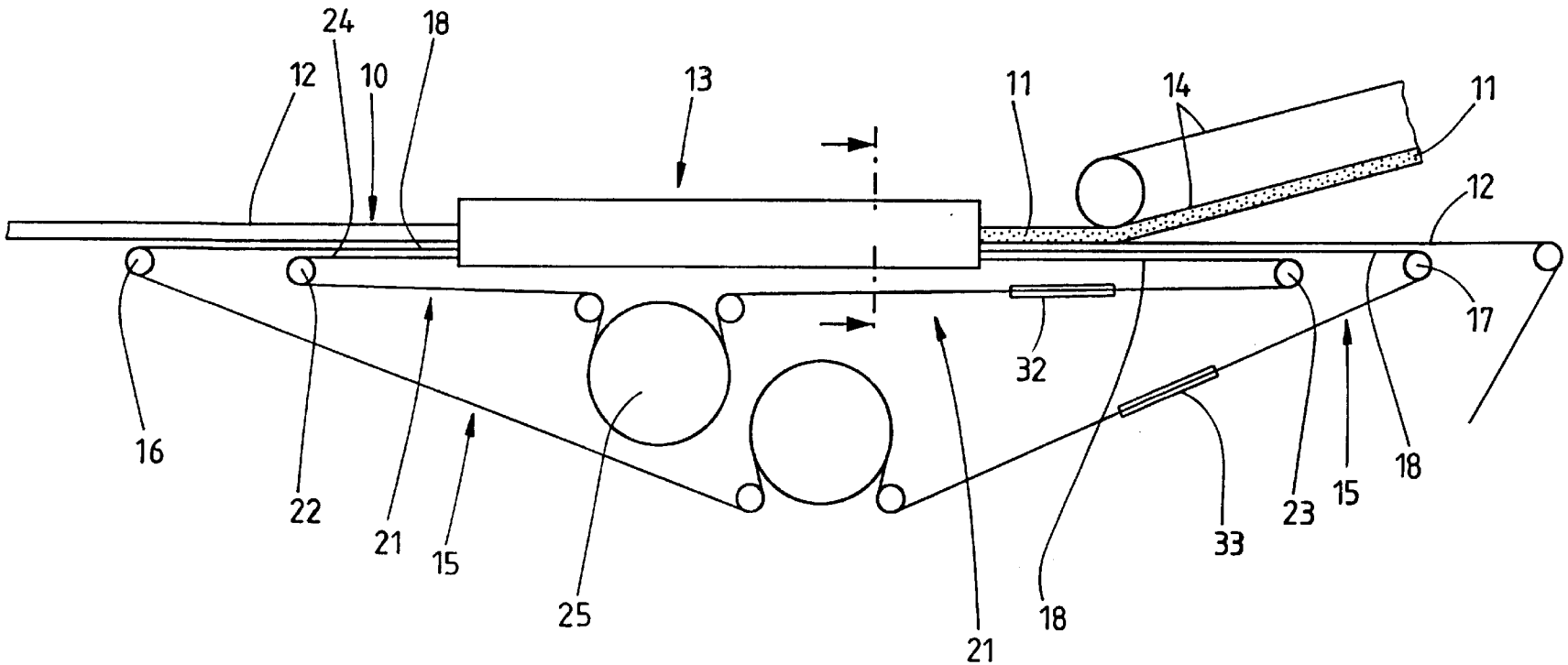
FIG. 1 shows a simplified side view of a rod-forming machine.

The exemplary embodiment which is illustrated in the drawings is concerned with the production of a continuous rod, to be precise of a cigarette rod 10. The latter comprises an inner tobacco rod 11 and an outer wrapper 12 made of cigarette paper.

FIG. 1 shows essential elements of a machine for forming (cigarette) rods. A rod-forming unit 13 forms the core of said machine. In the region of this unit, the tobacco rod 11 is combined with the outer wrapper 12, to be precise such that the outer wrapper 12 is formed around the tobacco rod 11 during continuous transportation. Overlapping borders of the outer wrapper 12 are connected to one another by adhesive bonding.

The tobacco rod 11, which is formed in a known manner, is fed from above by a tobacco belt 14. The tobacco belt 14 has a conveying strand inclined at an acute angle. The tobacco belt 14 is designed as a suction belt, with the result that the tobacco rod is retained, and transported, on the bottom strand of the tobacco belt 14 by suction air. The tobacco belt 14 is designed by side-bounding means such that the tobacco rod 11 resting against the tobacco belt 14 has already been preformed, that is to say has an approximately round cross-section and is conveyed into the rod-forming unit 13 in this way.

The tobacco rod 11 is deposited on the outer wrapper 12, which is fed as a planar material strip, outside or in front of the rod-forming unit 13. Accordingly, a unit comprising the tobacco rod 11 and outer wrapper 12 runs continuously into the rod-forming unit 13. The outer wrapper 12, or the material strip for forming the same, is drawn off from a reel (not shown).

The outer wrapper 12 or the material strip is deposited on a belt conveyor, namely a forming belt 15. The latter is guided over deflecting rollers 16, 17 so as to form a top, elongate conveying strand 18. The latter is fed the outer wrapper 12 first of all, and then the tobacco rod 11 is fed to it and deposited on the outer wrapper 12.

The forming belt 15 is deformed in the rod-forming unit 13 together with the outer wrapper 12 and the tobacco rod 11, with the result that the outer wrapper 12 encloses the tobacco rod 11, the cigarette rod 10 being formed in the process. Positioned for this purpose within the rod-forming unit 13 are stationary forming tools or wrapping elements which extend in the conveying direction, namely a fixed forming bed 19. The latter changes continuously in cross-section, namely from a level, initial position on the inlet side (on the right in FIG. 1) into a hollow form in which it virtually completely encases the tobacco rod or cigarette rod 10. The elongate forming bed 19 executes this change in cross-sectional shape continuously, steplessly, with the result that the strip-like parts which are conveyed in abutment against the forming bed 19, namely the forming belt 15 and outer wrapper 12, are gradually deformed to the form of the cigarette rod 10 during transportation. The forming bed 19 is positioned in a mount 20 which is adapted to this form.

In the case of the present exemplary embodiment of a rod-forming machine, the forming belt 15, or the conveying strand 18 thereof, only rests indirectly against the forming bed 19. An intermediate element, namely a compensating belt 21, is located between the forming belt 15 and forming bed 19. This likewise endless belt is guided over deflecting rollers 22, 23 which, on account of the way in which they are arranged relatively to one another, form a horizontal strand 24. The latter runs in a plane between the forming belt 15, or the conveying strand 18 thereof, and the surface of the forming bed 19. The compensating belt 21, or the horizontal strand 24 thereof, accordingly rests against the forming bed 19. Accordingly, friction which is produced by the forming bed 19 acts with respect to the compensating belt 21 rather than with respect to the forming belt 15.

In order to reduce the effects of the friction, in particular the formation of heat, the compensating belt 21 is driven in a specific manner, namely by a drive roller 25. The compensating belt 21 moves in the same direction as the forming belt 15. However, the speed of the compensating belt 21 is considerably lower than that of the forming belt 15. Expediently, the compensating belt 21 is moved at approximately half the speed of the forming belt 15. On the one hand, this results in reduced friction between the compensating belt 21 and forming bed 19. Furthermore, this results in likewise reduced friction between the forming belt 15 and compensating belt 21. This, in turn, results in reduced heat. Moreover, the compensating belt 21 forms an additionally sheet-like element for dissipating the heat from the rod-forming unit 13.

The compensating belt 21 expediently consists of specific, selected material. The latter should have high thermal conductivity as well as a low coefficient of friction. A thin spring-steel strip is suitable and, in addition, the latter has a high strength.

Figure 2:
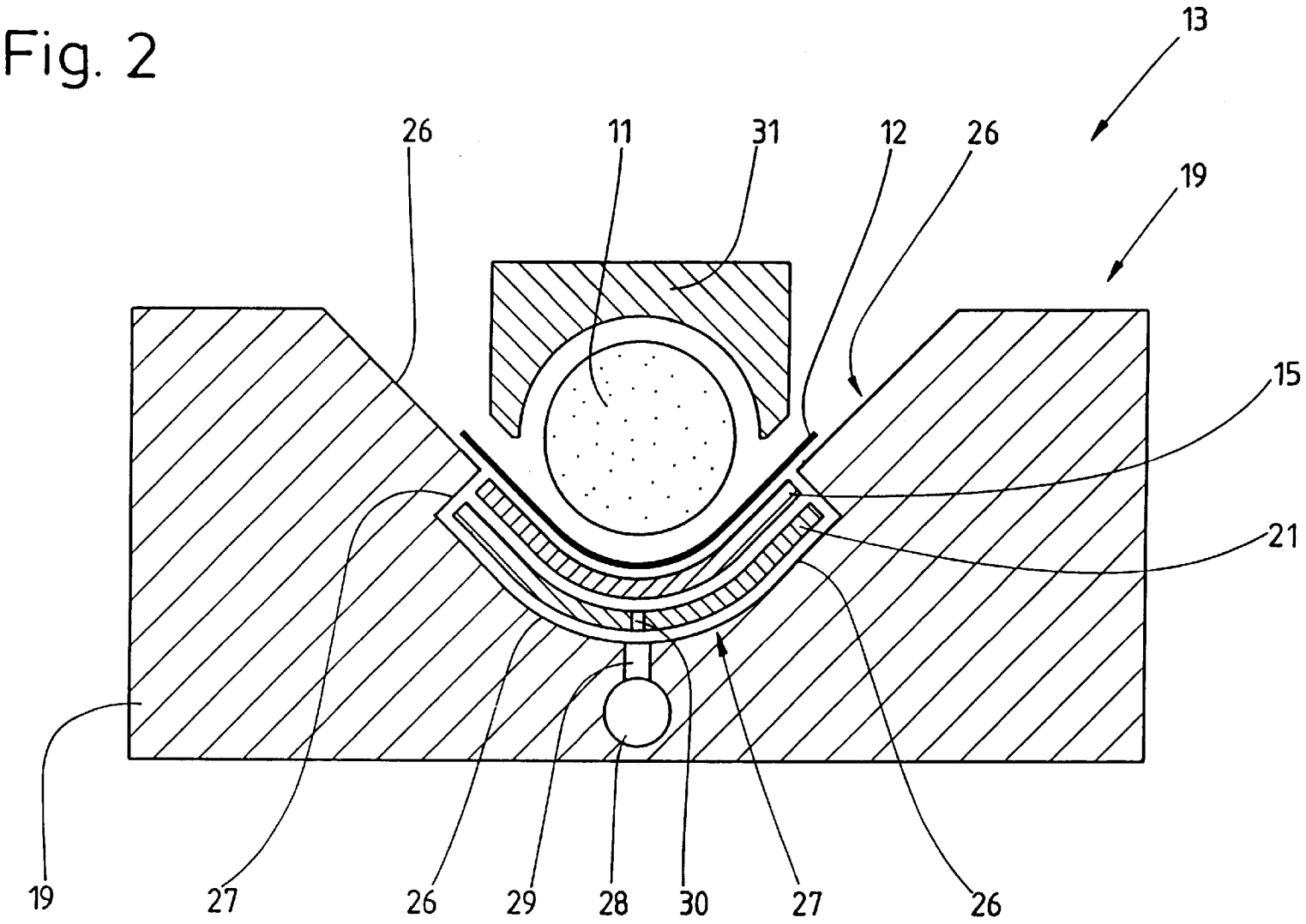
FIG. 2 shows, on an enlarged scale, a cross-section through a rod-forming unit of the rod-forming machine.

In the case of the present exemplary embodiment according to FIG. 2, the forming bed 19 comprises a forming body with a forming surface 26 in the form of a hollow. A depression 27, which extends in the conveying direction, is provided in said forming surface. In the depression, which is likewise in the form of a hollow, the forming belt 15 and the compensating belt 21 run one beside the other. The forming surface 26 or the depression 27 changes in the conveying direction such that the belts 15 and 21 enclose the tobacco rod 11 with the outer wrapper 12 to an increasing extent. In this case, the compensating belt 21 slides on the forming surface 26 in the region of the depression 27. The dimensions are selected such that the outer wrapper 12 projects laterally beyond the forming belt 15, and thus beyond the compensating belt 21, and rests against the forming surface 26 outside the depression 27.

For additional dissipation of heat there is arranged, in the body of the forming bed 19, a suction-extraction channel 28 which is connected to the forming surface 26 or the depression 27 by way of a plurality of transversely directed bores 29 which are spaced apart from one another in the longitudinal direction. Air can be extracted via the suction-extraction channel 28, and thus cooler air can be fed from the outside. Alternatively, it is also possible for cooling air to be fed via the suction-extraction channel 28. In this case, said channel acts as a compressed-air channel.

A special feature is that bores 30 are also arranged in the compensating belt 21. A row of such bores 30 extends in the longitudinal direction of the compensating belt 21, to be precise in the centre of the latter, adjacent to the bores 29 in the forming bed 19. The bores 30 can be used to produce negative pressure in the region of the forming belt 15, that is to say to produce cooling as well.

A further special feature of the bores 29, 30 and the suction-extraction channel 28 is that the negative pressure means that the belts 15 and 21 are precisely pressed or sucked onto the forming surface 26 of the depression 27 or of the forming bed 19. This provides for a more precise deformation of the two belts 15, 21.

A forming shoe 31 runs above the tobacco rod 11. Said shoe forms the tobacco rod 11 on the free, top side. The forming shoe 31 has a profile which changes in the longitudinal direction, that is to say it has a decreasing wall thickness.

For the purpose of improving the cooling effect, it is provided that the belts, namely the forming belt 15, on the one hand, and the compensating belt 21, on the other hand, run through a cooling unit 32, 33 outside the rod-forming unit 13. Said cooling unit may comprise a unit with cooling air or else with some other cooling medium.

What is claimed is:

1. Apparatus for producing a continuous rod (10) with an outer wrapper (12), the outer wrapper (12) being fed continuously as a material strip, and the material rod (11) which is to be wrapped resting on a driven forming belt (15) and being moved past forming beds (19) which, during transit, deform the outer wrapper (12) and material rod (12) to form the continuous rod (10), the forming belt (15) resting against the forming bed (19) with sliding action, which comprises the forming belt (15) resting against a heat-dissipating intermediate layer which is arranged between the forming belt (15) and the forming bed (19) and abuts against the forming bed (19), and wherein the intermediate layer is a heat-dissipating compensating belt (21) which is driven by a separate drive roller (25), other than the drive roller used to drive the forming belt and in the same direction, but at reduced speed with respect to the forming belt (15) whereby there is friction between the forming belt (15) and the compensating belt (21), and between the compensating belt (21) and the forming bed (19).

2. Apparatus according to claim 1, wherein the compensating belt (21) is driven at approximately one-half the speed of the forming belt (15).

3. Apparatus according to claim 1, wherein the compensating belt (21) consists of a material of high thermal conductivity and a low coefficient of friction.

4. Apparatus according to claim 1, wherein the forming belt (15) and compensating belt (21) are pressed onto forming surfaces (26) of the forming bed (19) by negative pressure, via suction bores (29, 30) in the forming bed (19) and in the compensating belt (21).

5. Apparatus according to claim 1, wherein the continuous rod (10) is a cigarette rod and the material rod (11) is a tobacco rod.

6. Apparatus according to claim 3, wherein the compensating belt (21) is spring steel.

7. Apparatus for producing a continuous rod (10) with an outer wrapper (12), the outer wrapper (12) being fed continuously as a material strip, and the material rod (11) which is to be wrapped rests on a driven forming belt (15) and being moved past forming beds (19) which, during transit, deform the outer wrapper (12) and material rod (11) to form the continuous rod (10), the forming belt (15) resting against the forming bed (19) with sliding action, which comprises the forming belt (15) resting against a heat-dissipating intermediate layer which is arranged between the forming belt (15) and the forming bed (19), and wherein the intermediate layer is a heat-dissipating compensating belt (21) which is driven by a separate drive roller (25), other than the drive roller used to drive the forming belt, and in the same direction as the forming belt (15) and runs between the forming belt (15) and the forming bed (19) and abuts against the forming bed (19), the compensating belt (21) being driven at reduced speed with respect to the forming belt (15) whereby there is friction between the forming belt (15) and the compensating belt (21) and between the compensating belt (21) and the forming bed (19).

8. Apparatus according to claim 7, wherein the compensating belt (21) is driven at approximately one-half the speed of the forming belt (15).

9. Apparatus for producing a continuous rod with an outer wrapper (12), the outer wrapper (12), which is fed continuously as a material strip, and the material which is to be wrapped rests on a driven-forming belt (15), and being moved past forming beds (19) which, during transit, deform the outer wrapper (12) and material rod (11) to form a continuous rod (10), the forming belt (15) resting against the forming bed (19) with sliding action, which comprises the forming belt (15) resting against a heat-dissipating intermediate layer which is arranged between the forming belt (15) and the forming bed (19) and which is a compensating belt (21), wherein the compensating belt (21) is driven by a separate drive roller (25), other than the drive roller used to drive the forming belt, and in the same direction of movement, at reduced speed with respect to the forming belt (15), such that there is friction between the forming belt (15), and the compensating belt (21), and between the compensating belt (21), and the forming bed (19).

10. Apparatus according to claim 9, wherein the compensating belt (21) is driven at one half the speed of the forming belt (15).

11. Apparatus according to claim 9, wherein the compensating belt (21) consists of a material of high thermal conductivity and a low coefficient of friction, in particular of spring steel.

12. Apparatus according to claim 9, wherein the forming belt (15) and compensating belt (21) can be pressed onto the forming bed, or onto forming surfaces (26) of the same, by negative pressure, via suction bores (29, 30) in the forming bed (19) and/or in the compensating belt (21).

13. Apparatus for producing a continuous rod (10) with an outer wrapper (12), the outer wrapper (12) being fed continuously as a material strip, and the material rod (11) which is to be wrapped resting on a driven forming belt (15) and being moved past forming beds (19) which, during transit, deform the outer wrapper (12) and material rod (12) to form the continuous rod (10), the forming belt (15) resting against the forming bed (19) with sliding action, which comprises the forming belt (15) resting against a heat-dissipating intermediate layer which is arranged between the forming belt (15) and the forming bed (19), and wherein the intermediate layer is a heat-dissipating compensating belt (21) which is driven by a separate drive roller (25), other than the drive roller used to drive the forming belt, and in the same direction as the forming belt (15) and runs between the forming belt (15) and the forming bed (19) and abuts against the forming bed (19).

* * * * *